US005090526A

United States Patent [19]

Jacober

[11] Patent Number: 5,090,526

[45] **Date of Patent: * Feb. 25, 1992**

[54] SELF SUPPORTING, SELECTIVELY COLLAPSIBLE SOFT-WALLED CARRIER

[75] Inventor: Jeffrey M. Jacober, South Kingston, R.I.

[73] Assignee: SGI Inc., Cranston, R.I.

[ * ] Notice: The portion of the term of this patent subsequent to Jan. 15, 2008 has been disclaimed.

[21] Appl. No.: 629,839

[22] Filed: Dec. 19, 1990

Related U.S. Application Data

[63] Continuation of Ser. No. 457,341, Dec. 27, 1989, Pat. No. 4,984,662.

[51] Int. Cl.[5] ..... A45C 7/00; A45C 13/02; A45C 13/08

[52] U.S. Cl. ..... 190/107; 190/109; 190/125; 190/126; 190/127; 206/315.2; 224/209; 383/2; 383/110

[58] Field of Search ..... 190/103, 107, 109, 110, 190/124–127; 383/2, 110; 206/316.2; 224/151, 209, 210

[56] References Cited

U.S. PATENT DOCUMENTS

| | | | |
|---|---|---|---|
| D. 151,950 | 12/1948 | Anderson . | |
| D. 227,946 | 7/1973 | Milette . | |
| D. 238,010 | 12/1975 | Canton . | |
| D. 243,637 | 3/1977 | Rabinowitz . | |
| D. 262,072 | 12/1981 | Pfeiffer | D3/36 |
| D. 265,268 | 7/1982 | Plough | D3/48 |
| D. 270,873 | 10/1983 | Katz et al. | D3/71 |
| D. 284,715 | 7/1986 | Jacober | D3/71 |
| D. 299,406 | 1/1989 | Jacober | D7/332 |
| 782,047 | 2/1905 | Pearson | 190/112 |
| 866,459 | 9/1907 | Gray | 190/111 |
| 896,529 | 8/1908 | Gray | 190/110 |
| 1,175,478 | 3/1916 | Shaw . | |
| 1,273,875 | 7/1918 | Kosta | 190/103 X |
| 1,600,909 | 9/1926 | Seward . | |
| 1,606,368 | 11/1926 | Horton | 190/13 R |
| 1,636,838 | 7/1927 | Roser | 190/103 |
| 1,667,014 | 4/1928 | Snell | 190/119 X |
| 1,930,043 | 10/1933 | Evens | 190/113 X |
| 2,018,809 | 10/1935 | Rodgers | 190/103 |
| 2,180,191 | 11/1939 | Bauch | 190/111 |
| 2,282,409 | 5/1942 | Lowe | 190/119 |
| 2,316,716 | 4/1943 | Ries | 190/109 X |
| 2,318,527 | 5/1943 | Rosenthal | 223/71 |
| 2,552,438 | 5/1951 | Kramer | 190/111 |
| 2,585,745 | 2/1952 | Crosby | 190/109 X |
| 2,631,632 | 3/1953 | Leachman | 190/109 |
| 2,861,661 | 11/1958 | Heitler | 190/122 |

(List continued on next page.)

FOREIGN PATENT DOCUMENTS

| | | | |
|---|---|---|---|
| 3528862 | 2/1987 | Fed. Rep. of Germany | 190/110 |
| 646926 | 11/1928 | France . | |
| 930251 | 1/1948 | France . | |
| 1333325 | 6/1963 | France | 206/316.2 |
| 9109549 | 7/1991 | PCT Int'l Appl. . | |
| 580953 | 9/1946 | United Kingdom | 190/107 |
| 940307 | 10/1963 | United Kingdom | 190/124 |
| 1572922 | 8/1980 | United Kingdom | 190/107 |
| 2210018 | 6/1989 | United Kingdom | 383/110 |

OTHER PUBLICATIONS

Ohio Bag Photographs of Six-Pack Cooler Carrier Product, no date available.

*Primary Examiner*—Sue A. Weaver

*Attorney, Agent, or Firm*—Lockwood, Alex, FitzGibbon & Cummings

[57] ABSTRACT

Upstanding soft-walled carriers having upstanding end panel doors are described. The soft walled carriers are made from a plurality of pliable panels, some of them having a resilient pliable construction, joined together along their edges by flexible corners. The panels cooperate in such manner that the carriers are self-supporting in a free upstanding position. A removable resilient pliable end panel insert is provided for additional support. In a preferred embodiment, the self-supporting soft walled carriers are also selectively collapsible along defined fold lines for self contained compressed storage.

10 Claims, 3 Drawing Sheets

U.S. PATENT DOCUMENTS

| | | | |
|---|---|---|---|
| 2,988,125 | 6/1961 | Reynolds | 190/111 X |
| 3,186,529 | 6/1965 | Gilbert | 312/244 |
| 3,396,832 | 8/1968 | Bloom et al. | 206/8 |
| 3,506,112 | 4/1970 | Feinberg et al. | 206/8 |
| 3,802,613 | 4/1974 | Droeger | 224/209 X |
| 3,963,103 | 6/1976 | Cowen | 206/315.1 |
| 3,994,372 | 11/1976 | Geller et al. | 190/107 |
| 4,063,581 | 12/1977 | Williams . | |
| 4,210,186 | 7/1980 | Belenson | 190/110 X |
| 4,210,230 | 7/1980 | Weiner | 190/107 |
| 4,212,377 | 7/1980 | Weinreb | 190/109 |
| 4,334,601 | 6/1982 | Davis | 190/111 X |
| 4,375,828 | 3/1983 | Biddison | 383/110 X |
| 4,506,769 | 3/1985 | Franco et al. | 190/108 |
| 4,544,051 | 10/1985 | Saltz | 190/124 |
| 4,545,414 | 10/1985 | Baum | 150/113 X |
| 4,561,525 | 12/1985 | Shidner | 190/106 |
| 4,598,746 | 7/1986 | Rabinowitz | 383/110 X |
| 4,610,286 | 9/1986 | Cyr | 190/110 X |
| 4,655,329 | 4/1987 | Kaneko | 190/127 X |
| 4,706,856 | 11/1987 | Jacober | 224/151 |
| 4,733,759 | 3/1988 | Shih-Chen | 190/18 A |
| 4,752,008 | 6/1988 | Pratt | 190/110 X |
| 4,765,416 | 7/1988 | Johnson | 190/107 X |
| 4,767,039 | 8/1988 | Jacober | 224/151 |
| 4,805,749 | 2/1989 | Gerch | 190/103 X |
| 4,817,802 | 4/1989 | Pratt | 190/110 X |
| 4,842,032 | 6/1989 | Mastronardo | 190/110 X |
| 4,940,173 | 7/1990 | Jacober | 224/151 |
| 4,984,662 | 1/1991 | Jacober | 190/107 |

SELF SUPPORTING, SELECTIVELY COLLAPSIBLE SOFT-WALLED CARRIER

This application is a continuation of copending application Ser. No. 457,341, filed Dec. 27, 1989, U.S. Pat. No. 4,984,662.

BACKGROUND OF THE INVENTION

The present invention relates to soft-walled carriers for clothing, sporting goods and the like. More particularly, it relates to a self-supporting and selectively collapsible soft-walled carrier which is generally tall and thin having a hinged door panel in an endwall of the carrier, with handle or carrying straps positioned so that the carrier is carried in a vertically oriented or upstanding position.

Soft-walled carriers for carrying numerous items are well known. Soft-walled carriers are desirable because they are relatively light weight and inexpensive when compared with earlier hard walled containers. More importantly, soft-walled containers can be collapsed, folded or compressed so that they may easily be stored in a locker or other out of the way location when not in use.

Soft-walled containers generally include a body defining an enclosure including a zippered or other recloseable opening intended to receive the articles. They usually include handles or straps to provide a convenient way to carry various articles. Most soft-walled carriers are provided with handles or carry straps that are positioned on the carrier so that the largest dimension of the carrier is disposed parallel to the ground for carrying. If the long dimension of the carrier is significantly longer than a persons front to back dimensions, as is often the case, the carriers may be cumbersome or awkward to carry, particularly when trying to negotiate with the carrier through doors or in a crowd.

Accordingly, in some carrier applications it is desirable to have the longest dimension of the carrier extend vertically with respect to the ground. This provides a relatively reduced width for the carrier making it less awkward to manage in crowded airports, public transportation and the like. Furthermore, a tall and thin container may be particularly desireable in an athletic context because the carrier may be configured to be directly placed into a locker. Moreover, a long thin carrier can be slid under an airplane seat in a manner which makes it easier to install and remove.

Tall and thin carrier bags adapted to be carried in a vertical orientation are known for example in U.S. Pat. No. 4,752,008. This patent describes a tall and thin carrier bag having an end panel door opening which is adapted to be slidably received within an athletic locker. However, this carrier is substantially rigid and includes a pair of spaced apart framing members which undesirably increases its cost and weight and the carrier is not collapsible.

A combination backpack and a soft walled removable thermally-insulative container, adapted to be received in a sleeve compartment on or within the backpack, is described in U.S. Pat. No. 4,767,039. The soft walled tall and thin container member adapted for carrying foodstuffs in a thermally insulated compartment described therein is a self supporting soft walled carrier which is provided with a top opening. A hinged lid including a downwardly projecting peripheral side wall or lip is hingedly connected to the carrier body. The lid is adapted to telescopically fit over the open end of the carrier to provide a continuous thermally insulating foam barrier to completely surround articles placed within the carrier compartment. The containers are self supporting but they are generally not collapsible.

Accordingly it is an object of the present invention to provide a generally tall and thin soft walled carrier having an end panel door opening which is self-supporting without the need for, framing members.

It is another object of the present invention to provide tall and thin soft walled carriers which are self-supporting and which may be selectively collapsed as desired in use.

SUMMARY OF THE INVENTION

In accordance with these and other objects, the present invention, in its broadest aspects, provides a self-supporting soft walled carrier. The carrier comprises a plurality of pliable panels including an upstanding end panel, a pair of upstanding side panels, a top panel and a bottom panel. The panels are joined together at their respective edges to form a shaped compartment defining an inner body cavity having a rectangular mouth opening opposite the end panel. The carrier further includes a rectangular end cover panel for selectively opening and closing the mouth opening. A removable end panel insert is provided which is adapted to be selectively abuttingly engaged against the end panel within the body cavity. The top, bottom, side, end cover and end insert panel members are each provided with a resilient pliable construction. The end panel has simply a pliable construction. The resilient pliable panels permit the carrier to be self-supporting and upstanding in a tall and thin vertically oriented position. The carrier further includes closure means for securing the cover to the body. The closure selectively joins or disjoins less than the full rectangular periphery of the cover panel. The remainder of the full periphery is hingeably attached to the body of the carrier.

Preferably, each of the resiliently pliable panels are provided with a panel construction including an inner and an outer web layer having overlying peripheral edges and a resilient foam sheet layer intermediate the inner and outer layers. The intermediate foam layer includes a peripheral edge portion that is disposed inwardly from and adjacent to the overlying peripheral edges of the web layers. In this manner, the carrier is made up of independent panels joined together along flexible edge portions which cooperatively enhance its self-supporting, upstanding performance characteristics.

In a preferred embodiment, the new and improved soft walled carrier of this invention is selectively collapsible. In accordance with this embodiment, the resilient pliable top and bottom panels include an intermediate fold line which effectively permits each of these panels to be folded inwardly, permitting the sidewalls of the carrier to be brought together into a collapsed, reduced width condition. The hinged cover panel or door is swingable inwardly to be fully received within the body cavity of the carrier so that it extends adjacent one of the side panels. The end panel insert may be disengaged from its position adjacent the end panel so that it lies parallel to a side panel in the collapsed condition.

Handle straps and carrier straps may be attached to the side walls and top walls respectively to enable the carrier to be hand carried in a vertically upright position. Backpack straps may be attached to a side wall panel of the carrier to enable the carrier to be carried in backpack fashion in its vertically upright position. A number of reclosable pockets may be provided on the interior of the cover panel or on the exterior of the carrier as desired.

Other objects and advantages of the present invention will become apparent from the following detailed description taken in conjunction with the drawings in which:

DETAILED DESCRIPTION OF THE PREFERRED EMBODIMENT

Figures 1, 2, 3, 4:
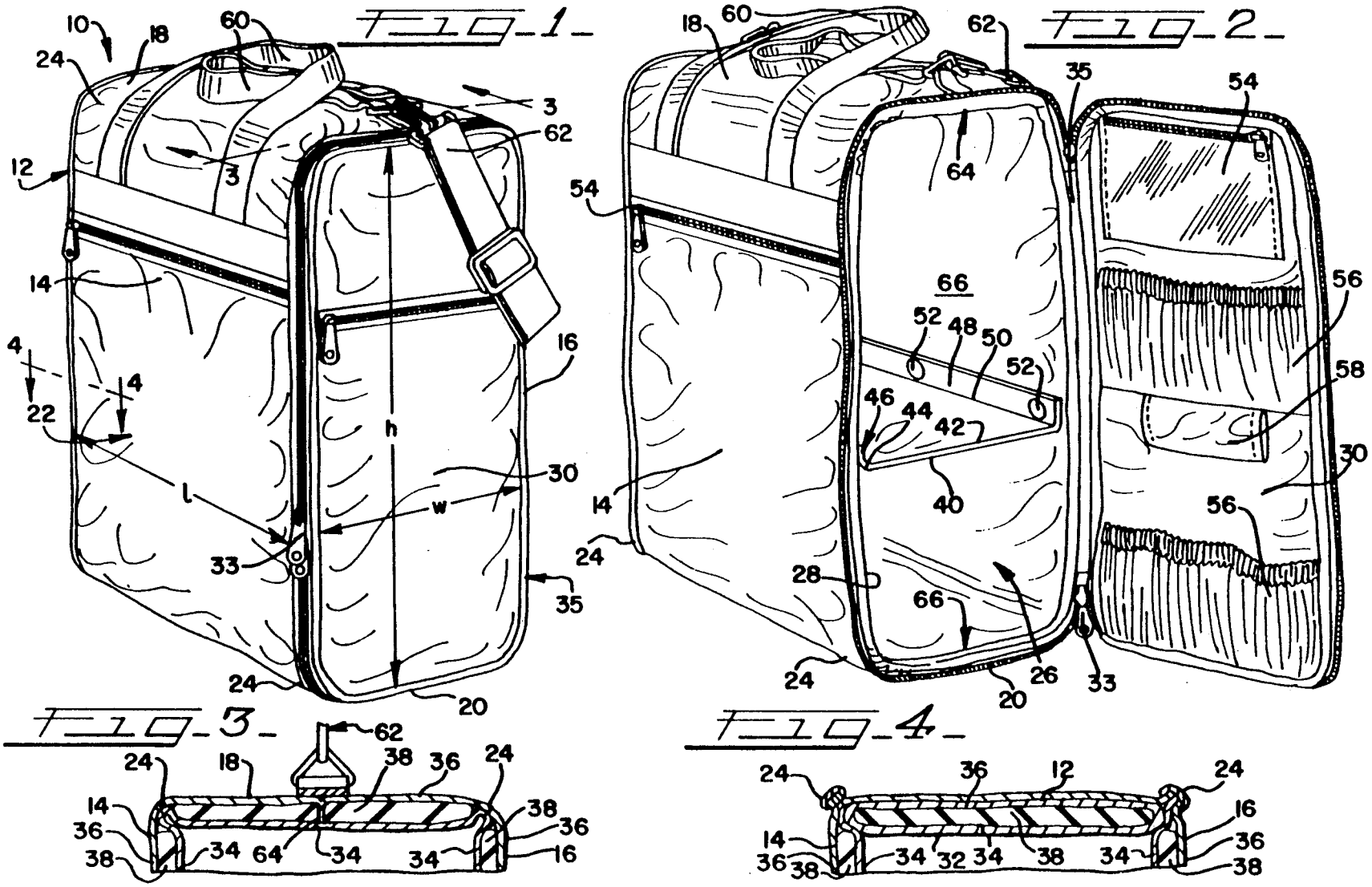
FIG. 1 is a perspective view of the new and improved self-supporting soft walled carrier of the present invention.
FIG. 2 is a perspective view of the new and improved soft walled carrier of the present invention shown with the end cover panel in its open condition.
FIG. 3 is a cross sectional view showing the panel construction of the new and improved carrier in accordance with this invention, taken along view lines 3—3 in FIG. 1.
FIG. 4 is a cross-sectional view of the new and improved soft walled carrier of the present invention, taken along view lines 4—4 in FIG. 1 illustrating the end panel insert in its installed condition.

Referring now to FIG. 1, the new and improved self-supporting soft-walled carrier 10 is shown. Carrier 10 has a tall and thin upstanding configuration. Carrier 10 is formed from a plurality of panels including a pliable end panel 12 indicated in FIG. 1 and shown in FIG. 4. Four resilient pliable panels including a pair of spaced and opposed side panels 14, 16, a top panel 18 and a bottom panel 20 extend forwardly from the end panel 12 as shown. Each of these panels are joined together at their respective edges to form a shaped compartment or carrier body 22 having flexible corners 24. Carrier body 22 defines a body cavity 26 having a rectangular mouth opening 28 opposite end panel 12, as shown in FIG. 2. Carrier 10 further includes a resilient pliable door or cover panel 30 having a rectangular configuration for selectively opening and closing mouth opening 28. Carrier 10 also includes a separate or independent resilient pliable end panel insert 32 best shown in FIGS. 4–5. A closure means in the form of a slide fastener or zipper 33 is provided to selectively join or disjoin less than the full rectangular periphery of door panel 30 to carrier body 26 adjacent mouth opening 28. The remainder of the full periphery forms a hinge connection or attachment 35 for door 30 to side panel 16, as shown in FIG. 2.

As shown in FIG. 1, carrier body 22 has a height dimension, h, defined between the top panel 18 and the bottom panel 20 which is greater than or equal to its length dimension, 1, defined between end panel 12 and rectangular mouth opening 28. Carrier body 22 also has a width dimension, w, is less than length dimension, 1. Carrier body 22 therefore has an upstanding tall and thin configuration.

Carrier 10 is generally self-supporting in an upstanding position without the need for additional frame or supporting members because of its unique construction being made up of resilient pliable panels 14, 16, 18, 20, interconnected by flexible corners 24 and by resilient pliable panels 30 and 32. More particularly and referring now to FIG. 3, each of the resilient pliable panels 14–20 and 30–32 include an inner web layer 34 and an outer web layer 36 disposed in parallel so that their respective peripheral edges overlie each other. A resilient foam sheet layer 38 is disposed intermediate inner and outer web layers 34 and 36. Foam sheet layer 38 has a peripheral edge portion disposed inwardly of and adjacent to the overlying peripheral edges of web layers 34 and 36. Flexible corners 24 are formed by sewing or otherwise joining adjacent panels 14–20 along their respective overlaying peripheral edges.

More particularly, as shown in FIG. 3, top panel 18 is shown in a lifted condition with respect to side panels 14 and 16, simulating the carrier 10 being carried by shoulder strap 62. When the carrier 10 is placed down on a surface such as a floor, top panel 18 will tend to move downwardly under the force of gravity with respect to side panels 14 and 16. As a result, the peripheral edge portions of foam layer 38 in top panel 18 are generally received between the adjacent peripheral edges of the foam layers 38 in side panels 14 and 16. This tends to bias the top portion of side panels 14 and 16 outwardly until the outer web layers 36 of top panel 18 and side panels 14 and 16 are tensioned. Accordingly, the upper ends of side panels 14 and 16 are prevented from collapsing inwardly or outwardly. Similarly, as can be appreciated, when the bottom panel 20 is placed on the floor, the peripheral edges of its foam layer 38 will move upwardly with respect to the peripheral edge portions of the foam layers 38 disposed at the lower ends of side panels 14 and 16. This biases the lower ends of side panels 14 and 16 outwardly tensioning the outer web layer 36 of bottom panel 20 and side panels 14 and 16. This action likewise prevents the lower ends of side panels 14 and 16 from inward or outward collapse.

Figure 5:
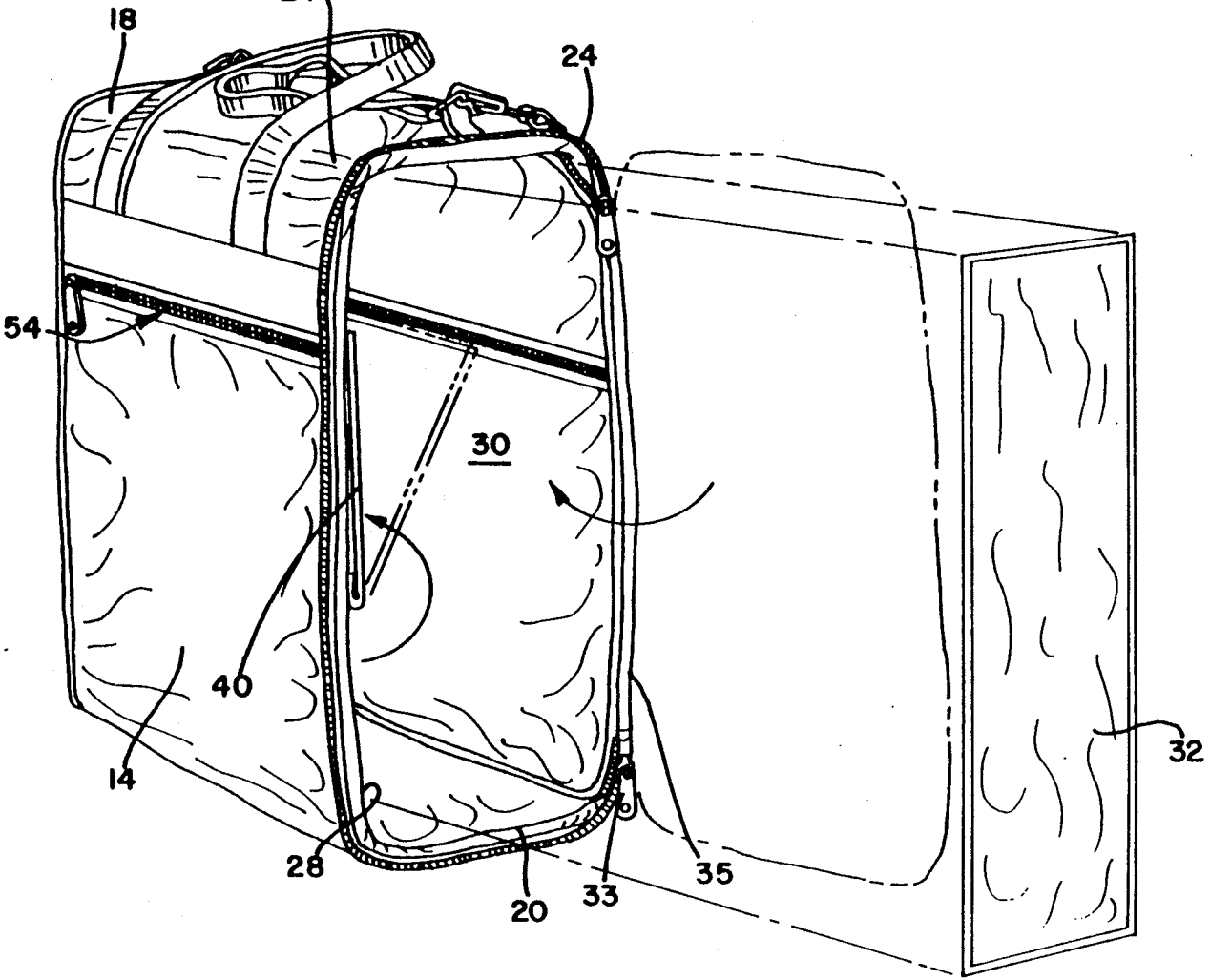
FIG. 5 is a perspective view of the new and improved soft walled carrier of this invention shown prior to collapsing, with the cover panel swung to an inward position and showing the end panel insert exploded from the carrier cavity in a disengaged position.

Referring now to FIGS. 4–5, in accordance with the preferred embodiment, carrier 10 includes a removable end panel insert 32 which is insertable through rectangular mouth opening 28 to be positioned in abutting engagement with end panel 12. Each of the resilient pliable panels 14, 16, 18 and 20 are also joined by means of a flexible corner 24 to pliable end panel 12. As shown in FIG. 4, resilient pliable end panel insert 32 is inserted so that the peripheral edge portions of its intermediate foam layer 38 are engaged between end panel 12 and the peripheral edge portions of adjacent adjoining foam layers 38 in panels 14, 16, 18 and 20. This engagement biases side panels 14 and 16 outwardly, top panel 18 upwardly and bottom panel 20 downwardly tensioning end panel 12 and the respective adjoining outer webs. As a result, the side panels 14 and 16 and opposing top and bottom panels 18 and 20 are stabilized being held parallel to each other, further contributing to self-supporting properties of the upstanding carrier body 22.

Preferably, pliable end panel 12 comprises a web of material. The webs useful for forming end panel 12 and inner and outer webs 34 and 36 may be the same or different and may be made from any suitable woven or non-woven, synthetic or natural sheet material suitable for forming a carrier covering. Preferably, the webs comprise a tough attractive woven fabric such as nylon, polyvinyl chloride, a polyurethane, cotton, canvas or the like. Suitable foam sheet materials for forming intermediate foam layers 38 generally include polyurethane foams. The thickness of the foam sheet materials may vary depending on the overall carrier body dimensions, but generally sheet materials having a thickness of between about ¼ to about 1½ inches are suitable for forming self supporting carriers having ordinary dimensions for such goods.

In the preferred embodiment shown in FIG. 2, carrier 10 optionally, but preferably, includes a shelf member 40 disposed within body cavity 26. Shelf member 40 includes a rigid planar intermediate portion 42 having first elongate edge 44 hingably connected at 46 to the inner surface of side panel 14 and an opposed tab projection 48 hingably connected to the opposed elongate edge 50. Tab projection 48 includes a plurality of spaced snap fasteners 52 adapted to engage complementary snap formations (not shown) projecting inwardly from spaced locations along inner surface of side panel 16, in accordance with well known fastening methods. Shelf 40 may selectively be swung or rotated upwardly as shown in FIG. 2 and the snap fasteners 52 engaged to provide a shelf member 40 extending parallel to top panel 18 and bottom panel 20 and between side panels 14 and 16 intermediate the height thereof. In its upward engaged position, shelf member 40 effectively subdivides body cavity 26 into an upper area and a lower area. Shelf 40 may optionally be disengaged at snaps 52 and swung downwardly to a position lying adjacent side panel 14, prior to collapsing the carrier 10 or as desired by the end user, as shown in FIG. 5.

Carrier 10 may also advantageously be provided with a plurality of pockets such as zippered pockets 54, elastic gather pockets 56, as well as sleeves 58, handle straps 60, and/or shoulder straps 62 as shown in FIGS. 1-2.

Figure 6:
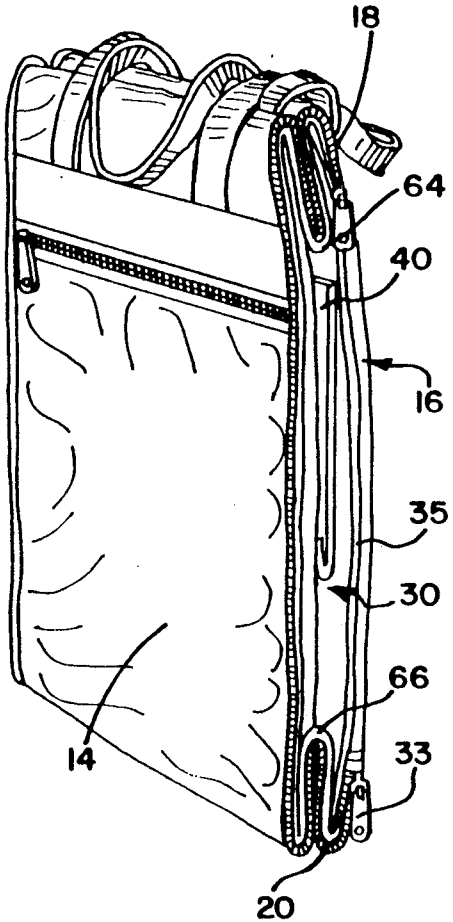
FIG. 6 is a perspective view of the new and improved selectively collapsible soft walled carrier of the present invention shown in its collapsed condition.

In accordance with the preferred embodiment, carrier 10 is not only self supporting but also is selectively collapsible for storage purposes as illustrated in FIGS. 5-6. In accordance with this aspect of the invention, the foam layers 38 preferably in top panel 18 and bottom panel 20 are preferably split in a lengthwise direction, intermediate the width thereof, to define inward fold lines 64 and 66, respectively.

To collapse carrier 10 from the position shown in FIG. 2, to the position shown in FIG. 6, shelf 40 is disengaged and lowered to the position shown in FIG. 5. End panel insert 32 is disengaged from end panel 12 and rotated so that insert 32 lies parallel and adjacent side panel 14 or 16. Door panel 30 is next swung inwardly about its hinge 35, through rectangular mouth opening 28, so that it extends completely within body cavity 26 to lie parallel and adjacent side panel 16. Thereafter, top panel 18 and bottom panel 16 are folded inwardly about fold lines 64 and 66 to bring side panel 14 adjacent side panel 16. In the collapsed position shown in FIG. 6, carrier 10 has a reduced width and is suitable for storage in an upright or lie flat condition.

Figure 7:
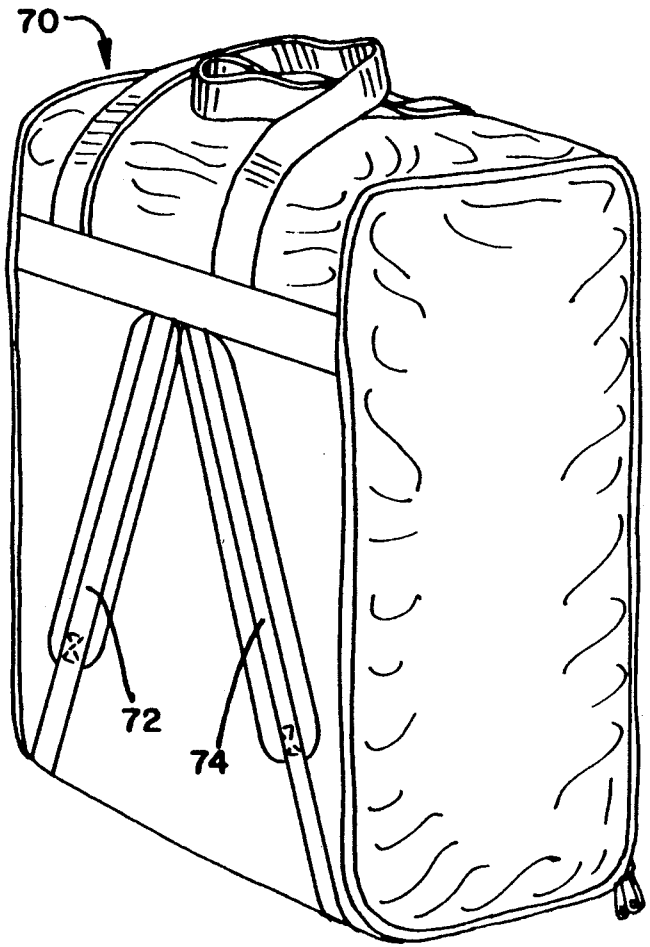
FIG. 7 is an elevated perspective view of an alternate embodiment of the new and improved self supporting soft walled carrier of this invention.

Referring now to FIG. 7, an alternate embodiment of the new and improved self supporting soft walled carrier, generally referred to by reference numeral 70 is shown. Carrier 70 is similar to carrier 10 with the exception that it is provided with a pair of angled backstraps 72 and 74 to enable carrier 70 to be worn on the back of a user. Accordingly, a self supporting frameless backpack carrier having an upstanding end panel door access opening is provided.

Figure 8:
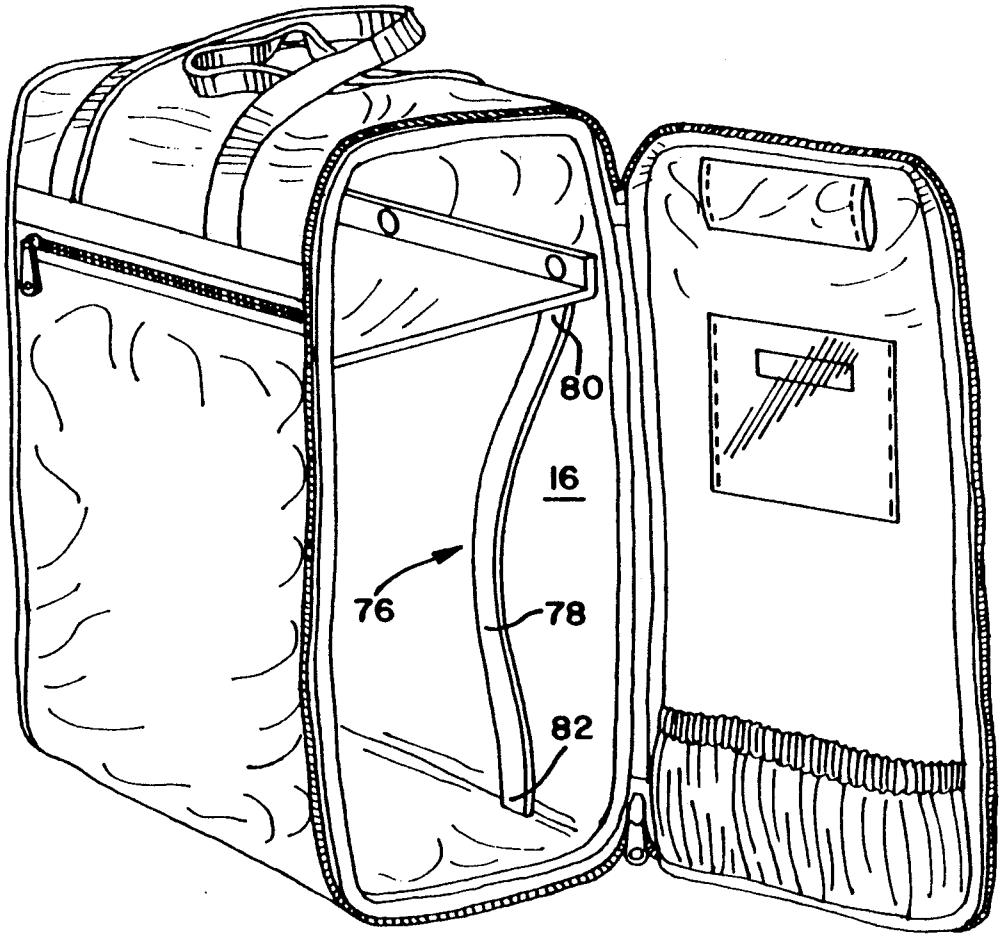
FIG. 8 is a perspective view of the alternate soft walled carrier shown in FIG. 7, viewed from the front and showing the cover panel in an open condition.

Referring now to FIG. 8, the body cavity 26 of carrier 70 is shown including a shelf member such as shelf 40 and including a verticle storage strap 76. Storage strap 76 includes a length of strap 78 having a pair of opposed ends 80, 82 each being attached or affixed to vertically aligned spaced locations on a side panel, such as panel 16. Verticle storage strap 76 is adapted to hold articles between the intermediate length of strap 78 and side panel 16 in a position parallel to side panel 16. One or more of straps 76 may be used to separately secure books, papers, pens or the like within the body cavity in carrier 78.

Although the present invention has been described with reference to certain preferred embodiments, modifications or changes may be made therein by those skilled in this art. For example, instead of joining the panels by sewing their peripheral edges together, the panels may be heat fused or affixed by means of a suitable adhesive. Instead of slide fasteners, other releasable closures such as ties, snaps, hook and loop tabs, straps and buckles and the like may also be used. Moreover instead of splitting the foam layers 38 in top panel 18 and bottom panel 20 to define fold lines 64 and 66, notches gussets score lines or the like may be used. All such obvious changes may be made herein without departing from the scope and spirit of the present invention as defined by the appended claims.

I claim:

1. A self-supporting soft walled carrier comprising: a plurality of pliable panels including an upstanding end panel, a pair of upstanding side panels, a top panel and a bottom panel, said panels being joined together at their respective edges to form a shaped compartment body defining an inner body cavity having a generally rectangular mouth opening opposite the end panel, said carrier including a generally rectangular end cover panel for selectively opening and closing said mouth opening, said side panels, top panel and bottom panel each having a resilient pliable construction, said carrier further including closure means for securing the end cover panel to said body, said closure means selectively joining or disjoining less than the full generally rectangular periphery of the end cover panel, the remainder of said full periphery including means for hingedly attaching the end cover panel to the body of the carrier, said carrier body having a height dimension defined between said top and bottom panels and said carrier including a shelf member extending parallel to said top and bottom panels mounted in said body cavity intermediate the height of the carrier body and effective to subdivide the cavity into upper and lower sections, and said carrier further including means for rendering it self supporting in the absence of rigid framing.

2. A carrier as defined in claim 1, wherein said shelf member includes a substantially rigid plate having a generally rectangular configuration with a pair of spaced and opposed elongate edges, said plate member including means for connecting said plate member along one of said edges to a side panel and having means defined on the other elongate edge for releasable attachment to mounting means provided on the opposing side panel.

3. A carrier as defined in claim 2, wherein said means for connecting comprises means for hingedly connecting said plate member along one of said side edges to a side panel.

4. A self-supporting soft walled carrier comprising: a plurality of pliable panels including an upstanding end panel, a pair of upstanding side panels, a top panel and a bottom panel, said panels being joined together at their respective edges to form a shaped compartment body defining an inner body cavity having a generally rectangular mouth opening opposite the end panel, said carrier including a generally rectangular end cover panel for selectively opening and closing said mouth opening and an end panel insert dimensioned to be selectively positioned in abutting engagement against said end panel within the body cavity, said side panels, top panel and bottom panel each having a resilient pliable construction and said carrier further including closure means for securing the end cover panel to said body, said closure means selectively joining or disjoining less than the full generally rectangular periphery of the end cover panel, the remainder of said full periphery including means for hingeable attachment to the body of the carrier, and said carrier body including means for rendering it self supporting in the absence of rigid framing.

5. A carrier as defined in claim 4, wherein said end panel insert is selectively disengageable from its abuttingly engaged position against said end panel within the body cavity to permit said carrier body to be selectively collapsed to provide a collapsed carrier characterized by reduced width.

6. A carrier as defined in claim 4, wherein said end panel insert is a separate panel, independent from the remainder of the carrier body.

7. A carrier as defined in claim 4, wherein said end panel insert, when in its abuttingly engaged position, is retained in said body cavity so that its peripheral edge portions are received between the end panel and adjacent peripheral edge portions of the top, bottom, and opposing side panels joined to said end panel.

8. A carrier as defined in claim 4, wherein said end panel insert and said end cover panel are also of a resilient pliable construction, said resilient pliable construction including an inner and an outer web layer having overlying peripheral edges and a resilient foam sheet layer intermediate the inner and outer layers, said foam layer having a peripheral edge portion disposed inwardly of and adjacent to the overlying peripheral edges of said web layers.

9. A self-supporting soft walled carrier comprising: a plurality of pliable panels including an upstanding end panel, a pair of upstanding side panels, a top panel and a bottom panel, said panels being joined together at their respective edges to form a shaped compartment body defining an inner body cavity having a generally rectangular mouth opening opposite the end panel, said carrier including a generally rectangular end cover panel for selectively opening and closing said mouth opening, said side panels, top panel and bottom panel each having a resilient pliable construction, said carrier further including closure means for securing the end cover panel to said body, said closure means selectively joining or disjoining less than the full generally rectangular periphery of the end cover panel, the remainder of said full periphery including means for hingeably attaching the end cover panel to the body of the carrier, said carrier body including a pair of angled back straps secured to one of said upstanding side panels to enable the carrier to be worn on the back of a user in backpack fashion in a vertically upright position, and said carrier including means for rendering it self-supporting in the absence of rigid framing, whereby a self-supporting back pack carrier having an upstanding end panel door access panel is provided.

10. A back pack carrier as defined in claim 9 further including handle strap means attached to said carrier so that the carrier may be hand carried in a vertically upright position.

* * * * *